US005865331A

United States Patent [19]

Jacobs

[11] Patent Number: 5,865,331

[45] Date of Patent: Feb. 2, 1999

[54] PACKAGE WITH A LIGHWEIGHTED CLOSURE SYSTEM

[75] Inventor: Andre Marie Gustav Jacobs, Zemst, Belgium

[73] Assignee: The Procter & Gamble Company, Cincinnati, Ohio

[21] Appl. No.: 687,578

[22] PCT Filed: Feb. 9, 1995

[86] PCT No.: PCT/US95/01722

§ 371 Date: Aug. 9, 1996

§ 102(e) Date: Aug. 9, 1996

[87] PCT Pub. No.: WO95/21775

PCT Pub. Date: Aug. 17, 1995

[30] Foreign Application Priority Data

Feb. 10, 1994 [EP] European Pat. Off. ..... 94200357

[51] Int. Cl.[6] ..... B65D 39/00

[52] U.S. Cl. ..... 215/228; 215/230; 215/318; 215/320; 215/321; 220/212

[58] Field of Search ..... 215/228, 318, 215/320, 321, 230; 220/212, 294

[56] References Cited

U.S. PATENT DOCUMENTS

| | | | |
|---|---|---|---|
| 3,231,122 | 1/1966 | Timgren | 215/321 |
| 3,826,397 | 7/1974 | Atkins | 215/318 X |
| 3,910,444 | 10/1975 | Foster | 215/318 X |
| 4,638,918 | 1/1987 | Marzabal Martinez | 215/295 |
| 4,671,421 | 6/1987 | Reiber et al. . | |
| 4,892,126 | 1/1990 | Bucheler et al. . | |
| 4,981,239 | 1/1991 | Cappel et al. . | |
| 5,020,692 | 6/1991 | Darr . | |
| 5,060,827 | 10/1991 | Segati . | |

*Primary Examiner*—Stephen Cronin
*Attorney, Agent, or Firm*—Elizabeth M. Koch; T. David Reed

[57] ABSTRACT

The present invention relates to a dosing cap (20) which is a measuring cup adapted to serve as a liquid tight closure. Said dosing cap is lightweighted by providing a wall with two different thicknesses. The thinner walled part (26) is inserted into the neck of the container to achieve the necessary closure. The thicker walled rest of said dosing cap (28) remains outside and serves as a gripping means to open the corresponding container (10).

12 Claims, 9 Drawing Sheets

PACKAGE WITH A LIGHWEIGHTED CLOSURE SYSTEM

FIELD OF THE INVENTION

The present invention relates to a package comprising a container and a measuring cup adapted to serve as a closure. The improvement of the present invention achieves a consistent saving in the manufacturing material, maintaining all the common characteristics of similar packaging, such as, for example, a liquid tight seal and self draining properties.

BACKGROUND OF THE INVENTION

Packages comprising a container and dosing cap are well known in the prior art. The container is able to contain liquid or granular substances. The dosing cap is a measuring cup adapted also to serve as a closing system. With the help of said dosing cap a certain contained substance is dosed and the container is closed in a detachable manner. Lightweighted packages are desirable, because of the low weight and reduced cost in materials required for their manufacture and the reduced cost related to the disposal. It is an object of the present invention to propose a package which achieves a consistent material saving in the manufacture of said package.

A problem associated with these packages is the spillage from said dosing cap onto the container, when it is applied again after use on the container, which can cause contamination of the closure systems, such as threads, with the contained product, as well as dripping along the container, making the closure and container messy, very slippery and thus difficult to handle.

To solve this problem various solution have been proposed. EP-B-0 369 560 describes an assembly, in which the measuring cup, threaded on the outside of said neck of the container, presents a skirt extending into the pouring spout body, which protects the threads of said measuring cup. A further improvement has been achieved with EP-A-0 417 954 in which the drain back trough is part of the container's body. Said trough has to be formed through an inversion of part of the neck of the container after the blow-molding process.

Other solutions are disclosed in U.S. Pat. No. 4,696,416 and U.S. Pat. No. 4,981,239. The dosing cap has a fastening means formed on its external surface, adapted to be sealed tightly to the interior surface of a collar secured to the orifice of the container. This means that no extra skirt is needed in this case to protect the threads of said dosing cap, although an intermediate piece, which joins the container and the dosing cap, is still required.

In all the previous solutions no limitations on the amount of the packaging material required has been set. On the contrary, more packaging material has been added to solve spillage problems through specific back draining means. The present invention reduces the necessary packaging material by inserting the dosing cap inside the neck of the container directly, as will be described further on.

In order to save material for the manufacturing of a package, which needs to be dosed, such as liquid and/or granular detergent, softeners, bleaches and the like, it would be more desirable that said package is comprised only of two parts: a container and a dosing cap, but no transition piece to convey the back drain. In particular, it would be more desirable for the same reason to avoid the forming of a back drain trough on the neck of the container.

We have now found that these objects are met by partly inserting the dosing cap into the neck of the container. This inserted part, protected by the neck of the container, needs not to be of the same resistance compared to the rest not inserted into said neck. Nevertheless, minimum constraints have to be taken into account, in order to determine the effective material saving.

The amount of packaging material or weight of the dosing cap is primarily determined by the mass density of the manufacturing material and the thickness of the wall of said dosing cap. The thickness determines the final resistance and stability properties of said cap. The resistance and the stability are important features of a reusable dosing cap, since it has to be gripped many times in order to open the container, especially considering that most of the commercially available containers are refillable.

SUMMARY OF THE INVENTION

The present invention is a package comprising a container and a dosing cap, said cap comprising a top and a circumferential wall. The wall of said cap has two different thicknesses, the thinner walled part of said cap fitting into the neck of said container, to achieve a liquid tight seal.

DETAILED DESCRIPTION OF THE INVENTION

Figure 1:
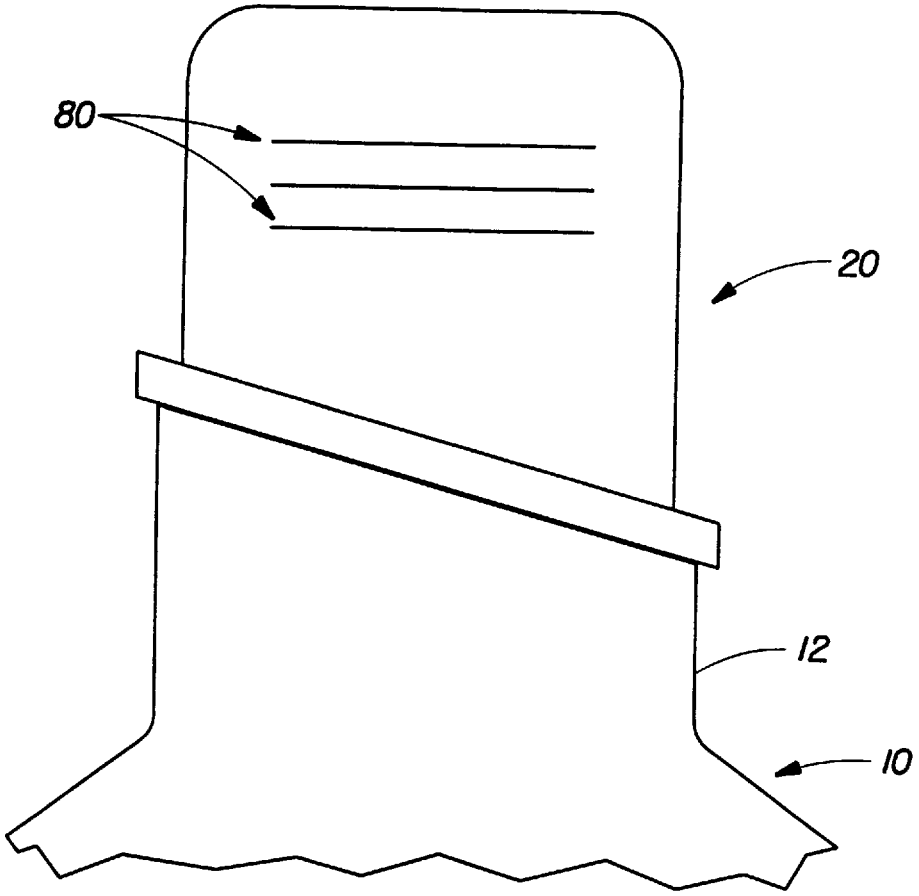
FIG. 1 is a fragmentary side view of the preferred embodiment of the present invention.

FIG. 1 illustrates the top end of the closed package in the preferred embodiment of the present invention, suitable for holding liquid or granular substances and the like. Preferably the container (10) is provided with a handle (not shown), integrally molded therewith, to provide a gripping means to facilitate holding and carrying the container (10) and dispensing its contents. The container (10) has a removably attached closure (20) to prevent in adverted spillage or loss of freshness of the contents of the container (10). The closure (20) may also be used as a measuring cup, to ensure the desired quantity of liquids is dispensed. The closure (20) is attached directly into the neck (12) of the container (10) in a liquid tight manner.

Figure 2:
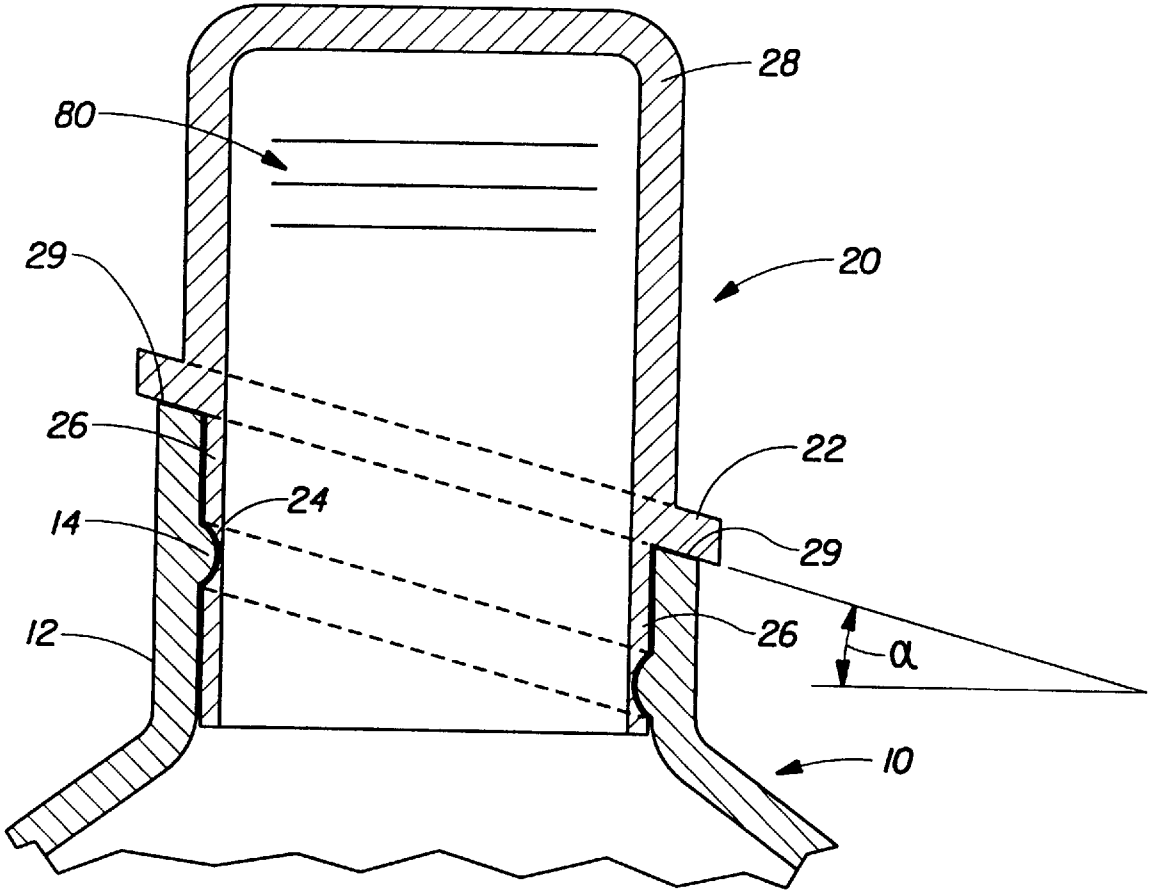
FIG. 2 is a fragmentary cross-sectional side view of the embodiment of FIG. 1.

FIG. 2 is a cross sectional side view of FIG. 1 showing the different thicknesses of the circumferential wall of said dosing cap (20). The thickness of said wall is defined to be the minimal distance between the inner and the outer surface of the wall. The thinner walled part (26) begins right under the external ridge (22). Said thinner part (26) fits into the neck (12) of container (10) in its closed position. Since said thinner part (26) of cap (20) is entirely protected by the neck (12) of container (10), said part (26) can be of a minor resistance and stability than the rest of the dosing cap (20). Since only a minor resistance and stability conditions are necessary, as explained before, part (26) can be thinner walled than the rest.

The thicker walled part (28) begins from the external ridge (22) upwards. This part (28) of said dosing cap (20) remains outside the neck (12). This part (28) needs to maintain a certain stability and resistance, since said part (28) has to be gripped firmly, in order to disconnect said dosing cap (20) from the neck (12) of container (10). This operation has to be accomplished many times.

The spillage free feature of the package of the present invention is another advantage, which is a direct consequence of the partial insertion of the dosing cap (20) into the neck (12) of container (10). It is evident that the rest of the dosed substance flows or falls automatically back into the container. This leads to the unnecessity of any drain back trough or other feature to convey the rest of any dosed substance back into the container. Not needing any particular drain back facility, as said before, also diminishes the amount of packaging material necessary for the package. This results in a significant material saving versus the packages of the prior art.

The dosing cap (20) may have two inclined features: the external ridge (22) and the groove (24). The groove (24) on the outer surface of part (26) of the dosing cap (20) fits exactly onto the identically sloped internal ridge (14). This internal ridge (14) is made on the inner surface of the neck (12) of container (10) and it has the identical shape of the groove (24), in order to get a liquid tight seal.

Figure 3:
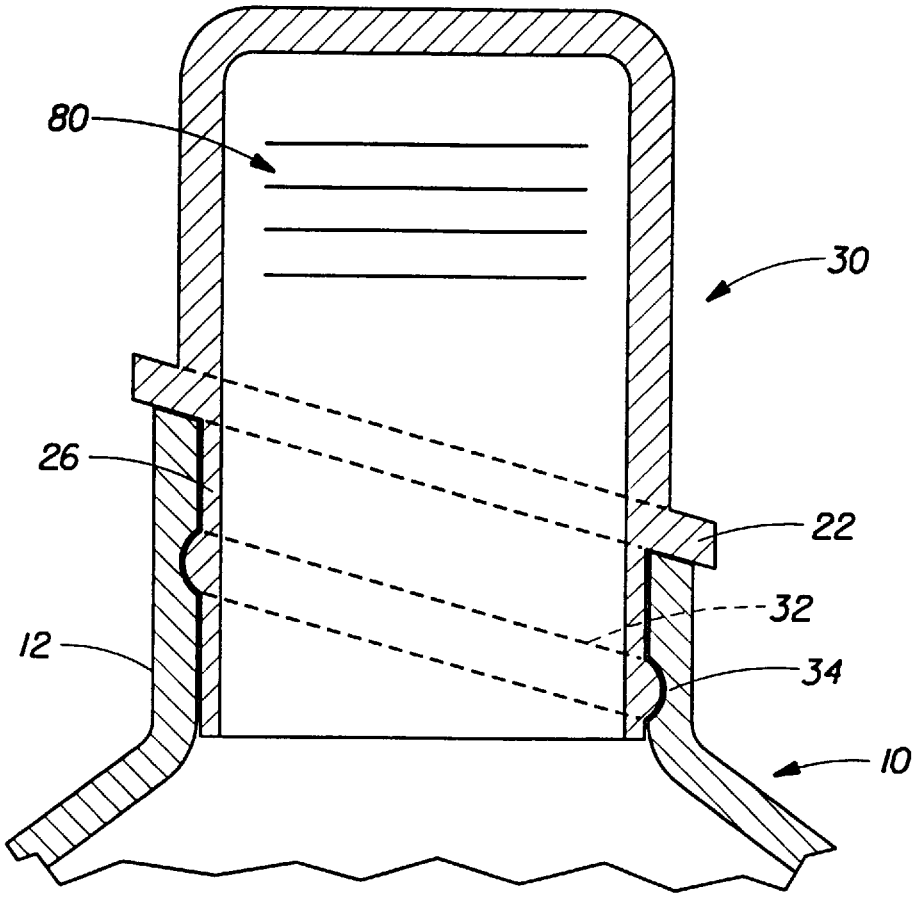
FIGS. 3 to 9 are fragmentary cross-sectional views of other embodiments of the present invention.

As shown in FIG. 3, the dosing cap (30) can also have two external ridges (22) and (32). The ridge (32) fits now into the groove (34) on the inner surface of the neck (12). The number and the shape of grooves (24) or ridges (32) and the corresponding internal ridges (14) and grooves (34) can be varied by any person skilled in the art.

The neck (12) of the container (10) not only contributes to the closure system, but it also serves as the pouring spout of the container of the present invention.

Referring again to FIG. 2, the fitting of the cap (20) into the neck (12) is only possible, if the lip (29) of the neck (12) is identically inclined as the external ridge (22) of cap (20). The inclination is defined by an angle $\alpha$. This angle a is measured from the plane defined by the supporting basis of the container (10) in its upright position to a line parallel to the lip of the neck (12) or external ridge (22). Therefore the angle $\alpha$ has to be always equal for both the external ridge (22) and the lip (29) of neck (12), in order to obtain a liquid tight seal.

Figure 4:
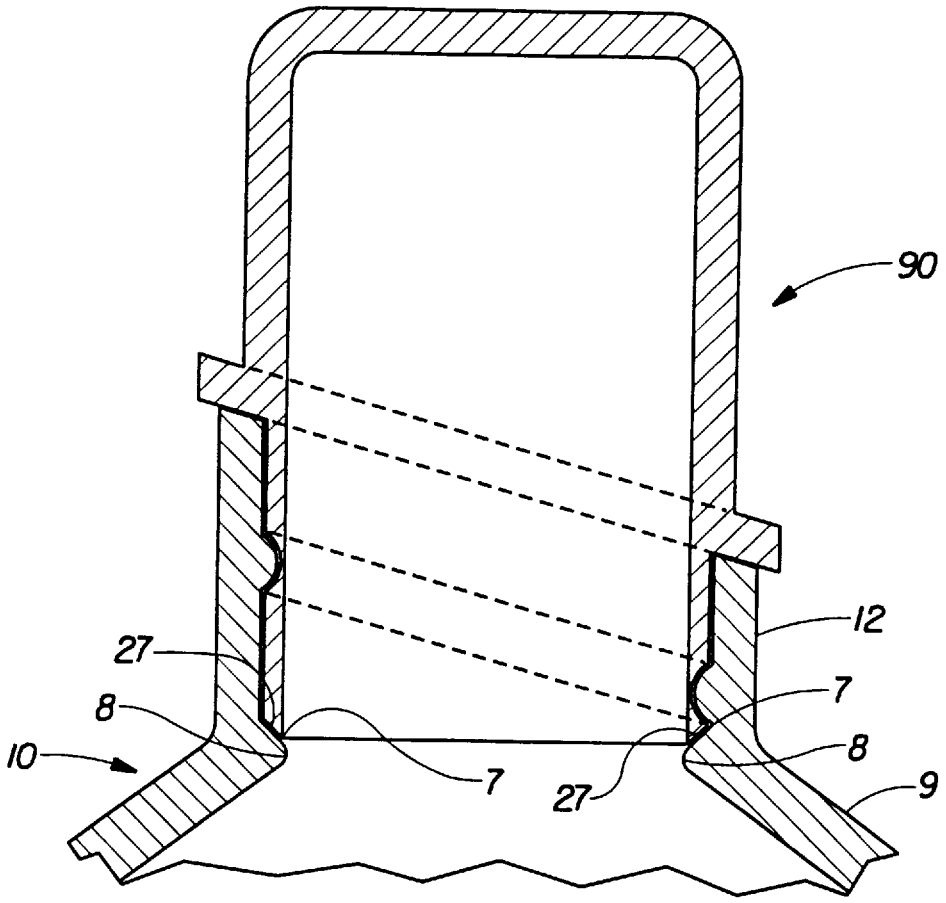

FIG. 4 schematically shows certain features which further improves the liquid tightness applicable to all embodiments. The new feature in respect to FIG. 2 is the ridge (8) between the neck (12) and collar (9) of the container (10). Said ridge (8) forms all around inside the neck (12) an area (7). Said area (7) is sloped in FIG. 4, but it can also be flat. Correspondingly, the lip (27) of the dosing cap (90) has the same slope as the area (7). The lip (27) of the dosing cap (90) coming in direct contact with area (7) assures an improved liquid tightness of dosing cap (90).

The inclined versions described so far are the preferred embodiments of the present invention, since said inclination of the lip (29) of neck (12) helps in separating the cap (20) from the container (10). In this manner, the cap (20) can be turned in respect to the neck (12); a ¼ turn at most is sufficient to force the ridge and the groove to disengage. Furthermore, the inclination of the lip (29) of neck (12) facilitates the use as a pouring spout of neck (12) to dose the contained substance out of the container into the dosing cap (20).

Figure 5:
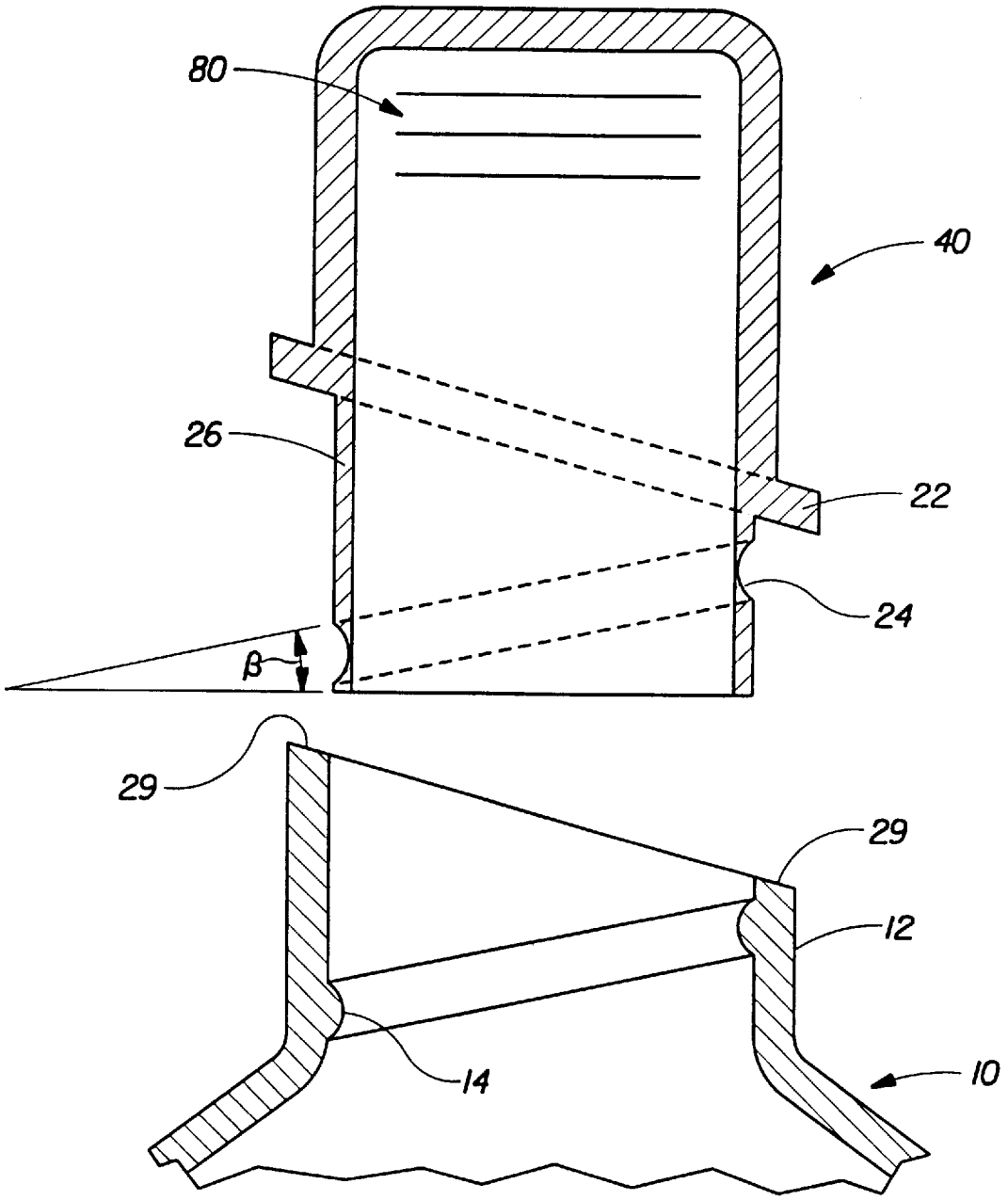

Nevertheless, other versions are possible with the same characteristical features between dosing cap (20;30) and neck (12) described above, which form the closure system, but with different angles between each other. One possibility is to have the external ridge (22) and the lip (29) of neck (12) inclined with an angle $\alpha$, whereas the groove (24) and the corresponding internal ridge (14) with another completely different angle $\beta$, as illustrated in FIG. 5. Angle $\beta$ is measured from the plane defined by the supporting basis of container (10) in its upright position to a line parallel to groove (24) or internal ridge (14). This includes also the following possibilities for the angles:

a) $\alpha=0$, $\beta=0$;

b) $\alpha=0$, $\beta=0$;

c) $\alpha=\beta=0$.

Figure 6:
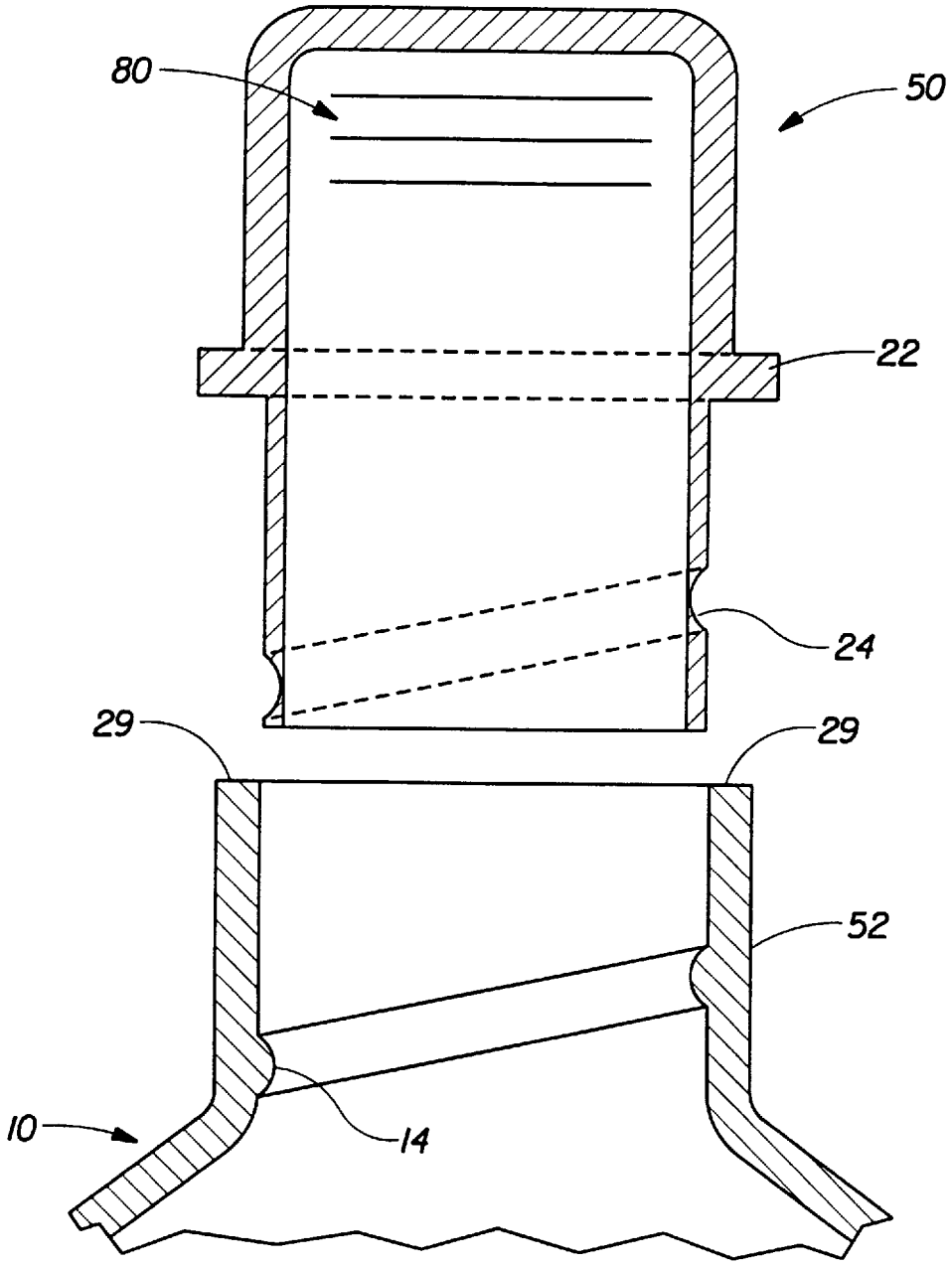
Figure 7:
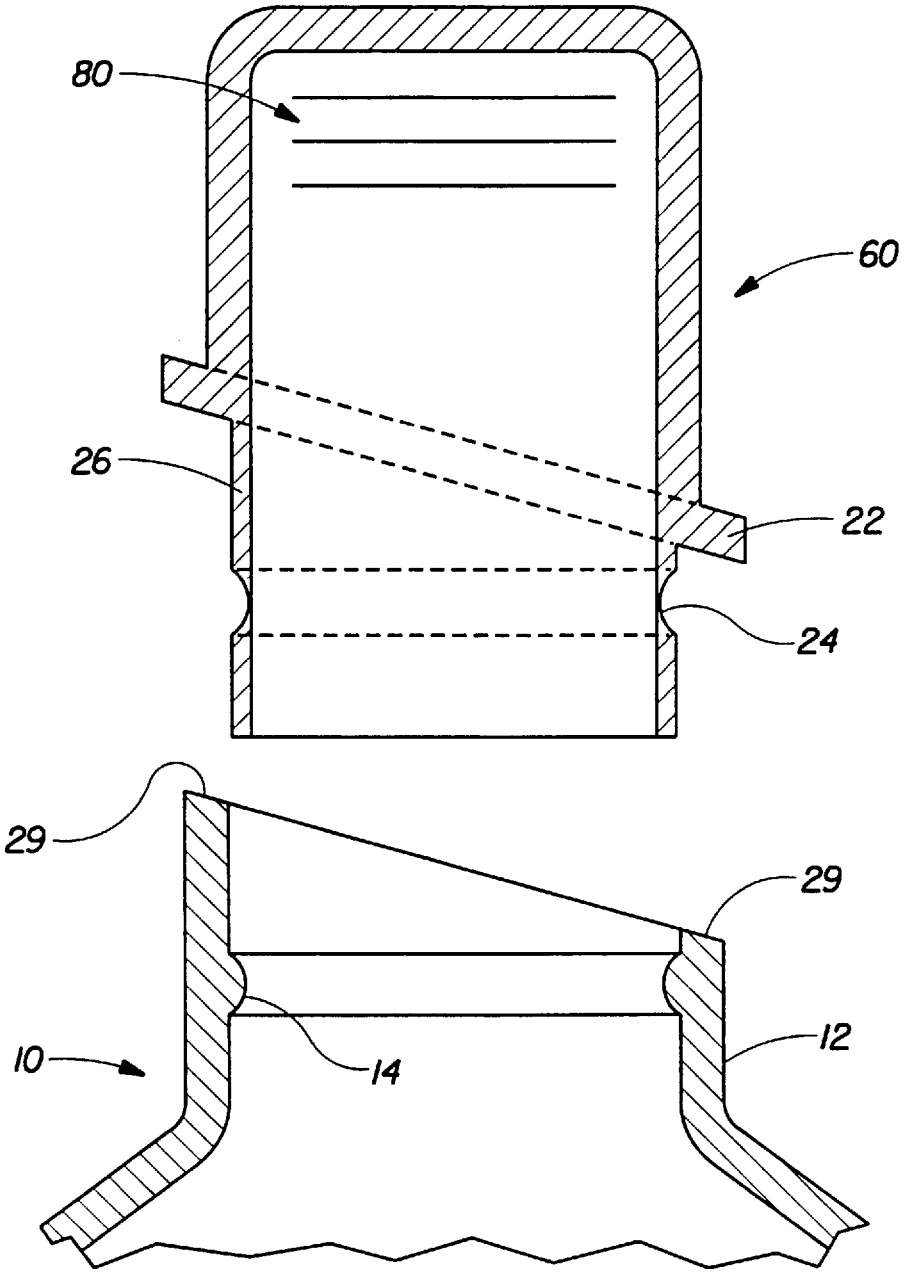
Figure 8:
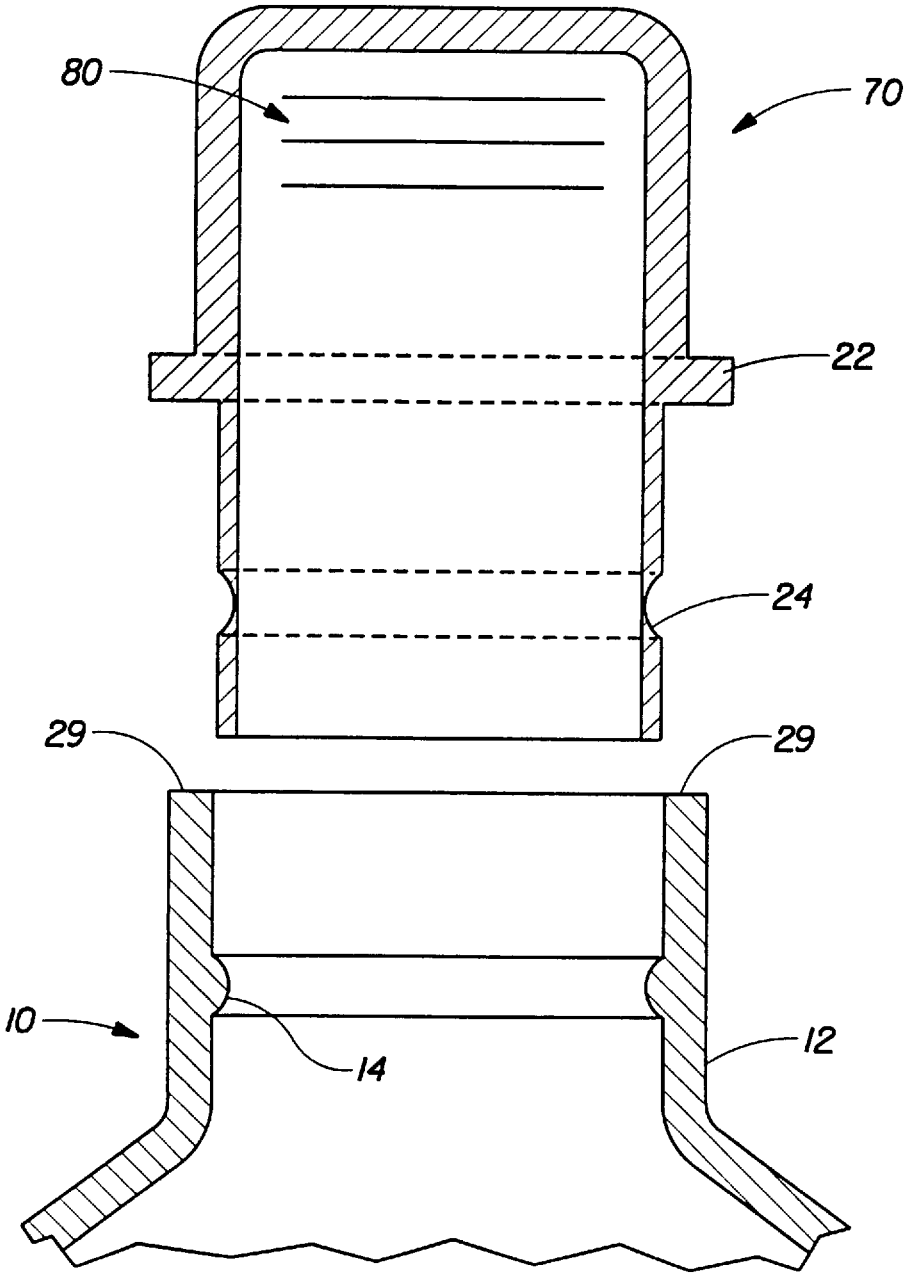

The possibility schematically described by the item a) is illustrated in FIG. 6. The external ridge (22) on the dosing cap (50) and the lip (29) of neck (12) have no inclination, on the contrary to groove (24) and internal ridge (14). The latter inclination is defined by $\beta$. The possibility b) is shown in FIG. 7, representing the exact opposite of case a): no inclination of groove (24) and internal ridge (14), an inclination defined by a for external ridge (22) and the lip (29) of neck (12). The possibility described by c) is a complete non-inclined version of the present invention and it is shown in FIG. 8.

Figure 9:
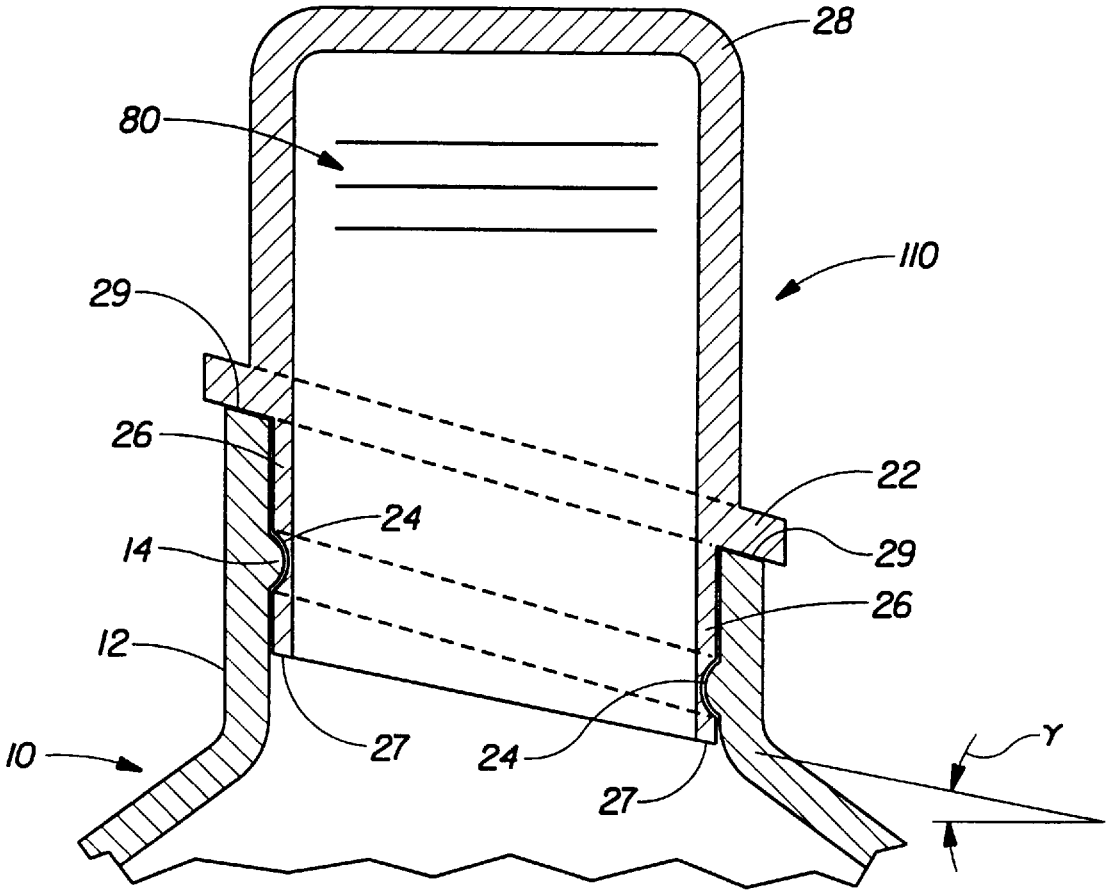

Another embodiment of the present invention is shown in FIG. 9. It is similar to FIG. 2 with the only difference that the lip (27) of the dosing cap (110) is also inclined with an angle $\gamma$. This angle $\gamma$ is measured from the plane defined by the supporting basis of the container (10) in its upright position to a line parallel to the lip of the dosing cap (110) The inclination of lip (27) helps the pouring out of the dosed substance. In all the Figures described above, the different thickness of the circumferential wall of the dosing cap is schematically illustrated.

The thickness of the walls of the dosing cap of the present invention may be up to 1.2 mm, preferably up to 0.6 mm, and most preferably from 0.1 mm to 0.3 mm especially for the thinner walled part of said cap. All the angles $\alpha$, $\beta$ and $\gamma$ have values, which can be chosen by any person skilled in the art for any necessary specific requirement. Preferably said values are from 0 radians to $5\pi/12$ radians, more preferably from $\pi/12$ radians to $\pi/3$ radians.

All embodiments described are preferably made of plastic, whereas the container is preferably blow-molded and the dosing cap injected. Nevertheless, as said before, the closure system itself does not limit the use of other commercially available manufacturing materials. The type of plastics usable for this type of application are generally thermoplastics, such as PolyEthylene (PE), PolyEthylene Terephthalate (PET), PolyPropylene (PP), PolyVinyl Chloride (PVC), and any other, less common polymers, like Polystyrene, PolyCarbonate and Ploymethane. These type of plastics is completely recyclable. It is possible to have material savings up to 80% compared to current self draining caps.

All the dosing caps shown in FIGS. 1 to 9 present on their outer and/or inner surface of the wall of said caps dosing lines (80). Said lines (80) help to dose precisely the contained substance out of the container (10). These lines (80) can be easily varied in number, depending from the specific uses of the contained substances.

The pouring spout of the container and the lip of said dosing cap for all embodiments are made anti-drip in order to avoid unnecessary product spillage. Furthermore, a pilfer proof ring, tape, shrink sleeve or the like to avoid cap loosening during transportation and distribution can be added.

The possible contained substances are all those ones, which need to be dosed for a specific use. For example, this happens very often in the laundry and household products, such as liquid or granular detergents, liquid softeners, household cleaners and bleaches.

What is claimed is:

1. A package, comprising:

a container having a neck; and a dosing cap having a wall and an external ridge, said wall having two different thicknesses, a thinner walled part of said cap fitting directly into said neck of said container, said external ridge tightly engages a lip of said neck in a closed Position and is situated on an outer surface of said cap separating said two different thicknesses of said wall, wherein said external ridge of said cap and said lip of said neck are inclined with an angle $\alpha$.

2. The package of claim 1, wherein a lip of said dosing cap is inclined with an angle $\gamma$.

3. The package of claim 1, further comprising another ridge which forms an area for improving the liquid tightness, said area coming in direct contact with a lip of said dosing cap.

4. The package of claim 1, wherein a lip of said dosing cap and said lip of said neck, both form anti-drip pouring spouts.

5. The package of claim 1, wherein an outer surface of said wall of said cap comprises a securing system, said securing system comprising at least one of a tamper-proof system, tape, and shrink sleeve to avoid loosening of said cap during transportation and distribution of said package.

6. The package of claim 1, wherein said cap comprises dosing lines on at least one of an outer and an inner surface of said wall of said cap.

7. A package, comprising:

a container having a neck; and a dosing cap having a wall, said wall having two different thicknesses, a thinner walled part of said cap fitting directly into said neck of said container, said cap comprises at least one of external grooves and ridges on an outer surface of said thinner walled part of said cap tightly fitting at least one of identically shaped internal ridges and grooves on an inner surface of said neck to form a liquid tight closure of said container with said cap, wherein at least one of said external grooves and ridges on said outer surface of said thinner walled part of said cap and said at least one of corresponding internal ridges and grooves on said inner surface of said neck of said container are inclined with an angle $\beta$, wherein said angle $\beta$ is equal to said angle $\alpha$.

8. The package of claim 7, wherein a lip of said dosing cap is inclined with an angle $\gamma$.

9. The package of claim 7, further comprising another ridge which forms an area for improving the liquid tightness, said area coming in direct contact with a lip of said dosing cap.

10. The package of claim 7, wherein a lip of said dosing cap and said lip of said neck, both form anti-drip pouring spouts.

11. The package of claim 7, wherein an outer surface of said wall of said cap comprises a securing system, said securing system comprising at least one of a tamper-proof system, tape, and shrink sleeve to avoid loosening of said cap during transportation and distribution of said package.

12. The package of claim 7, wherein said cap comprises dosing lines on at least one of an outer and an inner surface of said wall of said cap.

* * * * *